US007204587B2

(12) United States Patent
Choi et al.

(10) Patent No.: US 7,204,587 B2
(45) Date of Patent: Apr. 17, 2007

(54) INKJET PRINTER COMPRISING A DISCHARGE/HEATER ROLLER

(75) Inventors: Kyung-chool Choi, Suwon (KR); Jung-hwan Kim, Yongin (KR)

(73) Assignee: Samsung Electronics Co., Ltd., Suwon, Gyunggi-do (KR)

( * ) Notice: Subject to any disclaimer, the term of this patent is extended or adjusted under 35 U.S.C. 154(b) by 256 days.

(21) Appl. No.: 10/667,499

(22) Filed: Sep. 23, 2003

(65) Prior Publication Data

US 2004/0141039 A1 Jul. 22, 2004

(30) Foreign Application Priority Data

Jan. 22, 2003 (KR) ..... 10-2003-0004388

(51) Int. Cl.
*B41J 2/01* (2006.01)

(52) U.S. Cl. ..... 347/102; 347/101

(58) Field of Classification Search ..... 347/101, 347/105, 102, 103, 187, 100, 95, 96; 346/25; 101/488, 1; 34/1; 219/216; 399/320; 400/1
See application file for complete search history.

(56) References Cited

U.S. PATENT DOCUMENTS 5,111,250 A * 5/1992 Kashiwagi ..... 399/332
5,420,621 A * 5/1995 Richtsmeier et al. ..... 347/104
6,004,052 A * 12/1999 Muranaka ..... 347/105
6,029,040 A * 2/2000 Yamada et al. ..... 399/325
2002/0130939 A1* 9/2002 Jacob ..... 347/102
2003/0016269 A1* 1/2003 Sekiya ..... 347/102

* cited by examiner

*Primary Examiner*—Manish S. Shah
(74) *Attorney, Agent, or Firm*—Roylance, Abrams, Berdo & Goodman, L.L.P.

(57) ABSTRACT

An inkjet printer includes a print head forming an image by spraying ink from a nozzle towards a paper, a transfer unit for transferring the paper towards the print head, a discharge/heater roller being in contact with a side of the paper opposite to a side on which an image is formed by the print head for drying ink and discharging the paper, and one or more supporting rolls located above the discharge/heater roller and discharging paper together with the discharge/heater roller. The discharge/heater roller includes a heat-conductive cylindrical portion, a roller rubber covering the cylindrical portion and generating a friction force during discharging paper, and a heat-generator disposed on an inner surface of the cylindrical portion in an axial direction. The discharge/heater roller is disposed close to the print head, and the supporting roll includes a star wheel for minimizing a spread of ink on the image on the paper. The cylindrical portion is formed of an aluminum which has a heat-conductivity, and the heat-generator is a heater coil formed of nichrome wire.

6 Claims, 2 Drawing Sheets

INKJET PRINTER COMPRISING A DISCHARGE/HEATER ROLLER

This application claims benefit under 35 U.S.C. § 119 from Korean Patent Application No.2003-4388, filed on Jan. 22, 2003, the entire content of which is incorporated herein by reference.

BACKGROUND OF THE INVENTION

1. Field of the Invention

The present invention relates to an inkjet printer, and more particularly to an inkjet printer having an ink drying apparatus which has a simple structure and can effectively dry ink on paper.

2. Description of the Related Art

An inkjet printer is increasingly in demand in the market because it is generally quiet and able to print at a high resolution and print a color image at a low cost. Such an inkjet printer prints a desired image by spraying ink on paper through nozzles of a print head.

FIGS. 1 and 2 are sectional views schematically showing a conventional inkjet printer. Referring to FIGS. 1 and 2, a conventional inkjet printer will be described below.

In a conventional inkjet printer 10 as shown in FIG. 1, paper P stacked in a paper feed cassette 1 is picked up sheet by sheet by a pickup roller 2. The picked up paper P is fed towards a print head 6 along a paper guide 3 by a feed roller assembly 4 which includes feed rollers 4*a* and 4*b*. A desired image is formed on the paper P as ink is sprayed from the print head 6 into which an ink cartridge 5 has been loaded. The paper P with the image formed thereon is discharged outside a printer 10 by a discharge roller assembly 7 which includes discharge rollers 7*a* and 7*b*.

During the printing process of the inkjet printer 10, the paper P gets wet by ink sprayed from the print head 6. In order to prevent the wet paper P from being distorted and ink from spreading on the paper P, the paper is dried after printing.

The inkjet printer 10 shown in FIG. 1 allows ink to naturally dry. However, such a natural dry method is not suitable for an inkjet printer which is developed to run faster by an advanced printer technology.

Since printing speed heavily depends on the speed of ink drying on paper, one cannot expect an increase in printing speed while insuring that the next paper sheet is not affected by the ink that has been sprayed on the current paper sheet. Accordingly, the natural dry method is not suitable for high speed printing and causes print quality degradation. In addition, since the sprayed ink is dried naturally and thus takes too long to dry, the paper tends to become distorted during the drying process.

In order to solve the above-mentioned problem, a means for drying ink such as a heater roller 8 has disposed between the discharge roller assembly 7 and the print head 6 of the inkjet printer 10 as shown in FIG. 2. Hence, this type of inkjet printer 20 dries ink by warming the bottom of the paper P through the use of the heater roller 8.

Accordingly, as the paper P passes the heater roller 8, the ink sprayed on the paper P from the print head 6 is dried, and high printing quality can be obtained even in case of high speed printing. In addition, since the sprayed ink is quickly dried, printing quality can be improved even more and the paper P can be prevented from being distorted.

However, because such an inkjet printer 20 requires the separate discharge rollers 7*a* and 7*b* and the heater roller 8, manufacturing costs increase.

In addition, considering a trend demanding a fast and compact printer, these two extra members increase the overall size of the printer, which is undesirable.

SUMMARY OF THE INVENTION

An aspect of the invention is to solve at least the above problems and/or disadvantages and to provide at least the advantages described hereinafter.

Accordingly, one aspect of the present invention is to solve the foregoing problems by providing a compact inkjet printer which can reduce manufacturing costs by integrally forming a discharge roller of an inkjet printer and a heater roller for drying ink.

In order to achieve the above aspects and/or other features and advantages of the present invention, an inkjet printer includes a print head forming an image by spraying ink from a nozzle towards a paper, a transfer unit for transferring the paper towards the print head, a discharge/heater roller which contacts a side of the paper opposite to a side with an image formed thereon by the print head to dry the ink while also discharging the paper, and one or more supporting rolls located above the discharge/heater roller for discharging the paper together with the discharge/heater roller. The discharge/heater roller includes a heat-conductive cylindrical portion, a roller rubber covering the cylindrical portion and generating a friction force during the paper discharging operation, and a heat-generator disposed on an inner surface of the cylindrical portion in an axial direction.

The discharge/heater roller is disposed close to the print head. The supporting roll includes a star wheel for minimizing a spread of ink on the image on the paper. The cylindrical portion is formed of an aluminum which has good heat-conductivity. The heat-generator is a heater coil formed of nichrome wire or any other suitable components.

According to an embodiment of the present invention the heater roller and the discharge roller are integrally formed as one member instead of as separate members, thereby reducing manufacturing costs while also providing an inkjet printer which is compact-sized and occupies less space. Also, a high printing quality image is guaranteed even during high speed printing, and because the sprayed ink dries very quickly, printing quality further improves and damage to the printing sheet due to wet ink is prevented.

BRIEF DESCRIPTION OF THE DRAWINGS

The above objects and features of the present invention will be more apparent by describing an embodiment of the present invention with reference to the accompanying drawings, in which.

DETAILED DESCRIPTION OF THE PREFERRED EMBODIMENT

Figure 1:
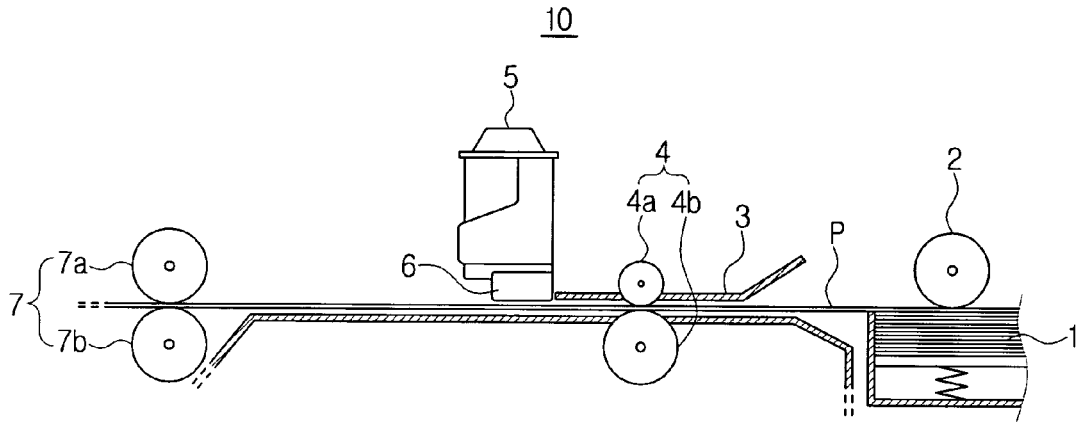
FIG. 1 (PRIOR ART)
FIG. 1 is a sectional view schematically showing a conventional inkjet printer.
Figure 2:
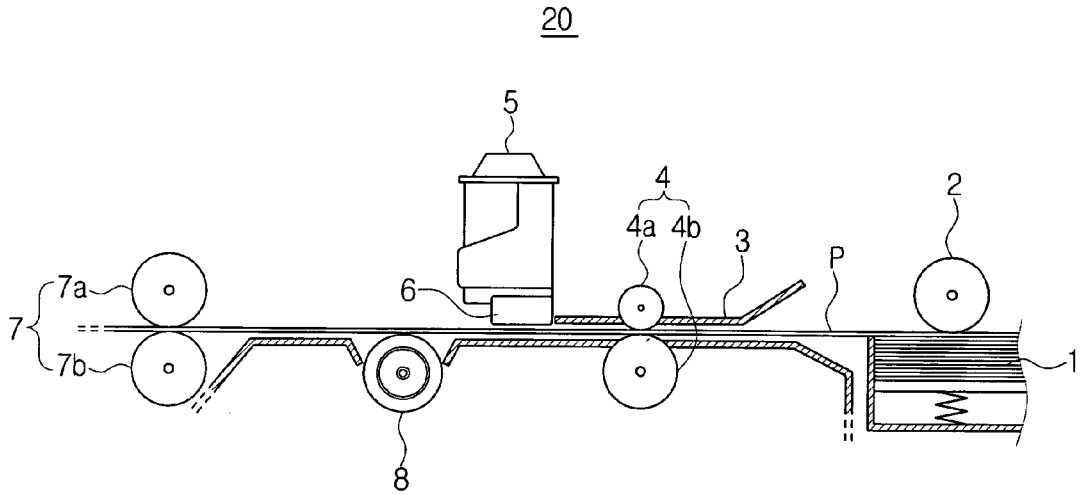
FIG. 2 (PRIOR ART)
FIG. 2 is a sectional view schematically showing another conventional inkjet printer.

Hereinafter, an inkjet printer having an ink drying apparatus according to an embodiment of the present invention will be described in greater detail with reference to the accompanying drawings. With respect to the elements identical to those of the prior art, like reference numerals will be assigned.

Figure 3A:
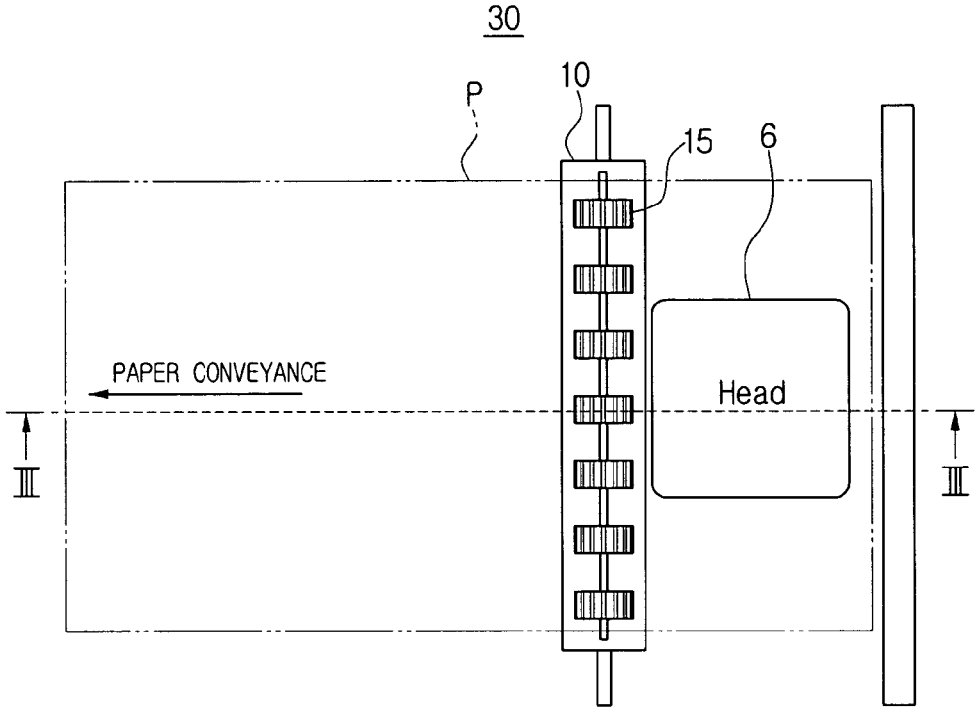
FIG. 3A is a plan view schematically showing an inkjet printer employing an ink drying apparatus according to an embodiment of the present invention.
Figure 3B:
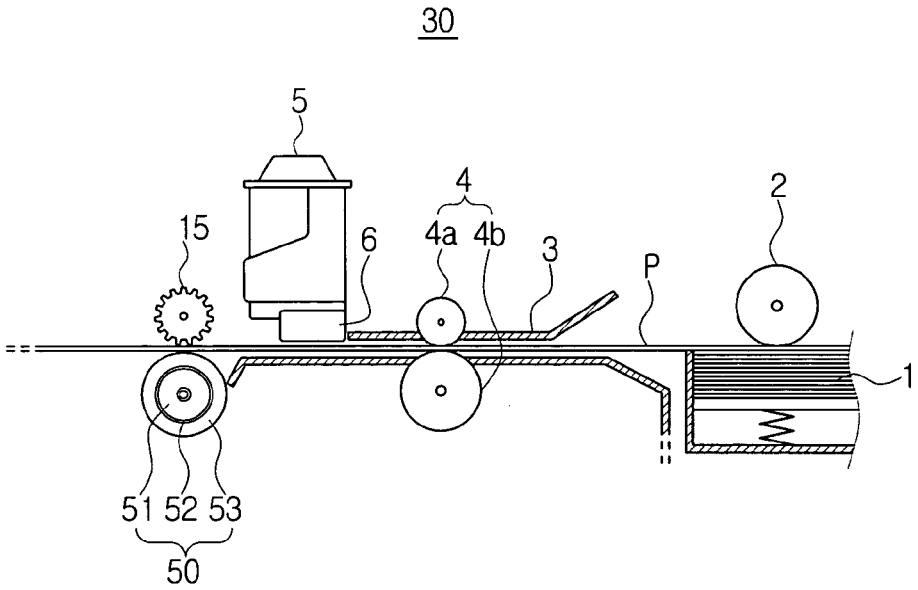
FIG. 3B is a sectional view showing FIG. 3A taken along III—III.

FIGS. 3A and 3B are a plan view and a sectional view of an inkjet printer according to an embodiment of the present invention.

The inkjet printer 30 according to an embodiment of the present invention comprises a paper feed portion 1, a pick-up roller 2, a paper guide 3, a feed roller assembly 4 including feed rollers 4*a* and 4*b*, a print head 6, a star wheel 15, and a discharge/heater roller 50.

The paper feed portion 1 has a plurality of paper P stacked therein on which to be printed, and the pick-up roller 2 picks up the paper P sheet by sheet from the paper feed portion 1 and feeds the sheet of paper towards the print head 6 when a print signal is received by the printer system.

The feed rollers 4*a* and 4*b* feed the paper P picked up by the pick up roller 2 towards the print head 6, and the paper P is guided towards the print head 6 after having the front, left and right end aligned.

The print head 6 is disposed in an ink cartridge 5 mounted on a carriage (not shown). The carriage reciprocates rectilinearly by a carriage guide apparatus (not shown) of the inkjet printer 30, and ink is sprayed onto paper P from nozzles of the print head 6 and thus, a desired image is created.

In order to prevent the sprayed ink in a liquid phase from spreading on the paper P, and the paper P from being distorted, ink needs to be quickly dried. Accordingly, the discharge/heater 50 is disposed under the paper P which has just passed the print head 6, that is, in front of the print head 6.

In order to heat of the paper P to approximately 80° C. through 150° C., the discharge/heater roller 50 according to an embodiment of the present invention comprises a cylindrical portion 51 made of a heat-conductive material, a rubber 53 covering the cylindrical portion 51 for increasing a discharge friction force of the paper P, and a heat-generator 52 disposed inside the cylindrical portion 51.

According to an embodiment of the present invention, the cylindrical portion 51 is formed of aluminum which has a high heat-conductivity. However, the cylindrical portion 51 can be formed of any suitable conductive material.

In addition, it is preferable that the rubber 53 is formed of silicone rubber. However, the rubber 53 can be formed of any material as long as it is highly heat-conductive, flexible and heat-resistant against the temperature over approximately 80° C. through 150° C. Therefore, even though the paper P is uneven, it can be heated and dried evenly across the entire surface as rubber is formed of a flexible material. Also, a discharge friction can be increased when the paper P is discharged.

Meanwhile, the heat-generator 52 is formed as heating wire is disposed along the axial direction of the cylindrical portion 51. Preferably, the heat-generator 52 is formed of a heater coil such as nichrome wire, but can be any suitable material. The heat-generator 52 is connected with a temperature controller (not shown) and is adjusted to have the temperature of approximately 80° C. through 150° C.

When a print signal is received by the inkjet printer 30 structured as above, the discharge/heater roller 50 is driven and preheated up to a temperature necessary for drying ink on the paper P.

The discharge/heater roller 50 has a function of drying ink and also a function of discharging the paper P outside the inkjet printer 30, and thus it is preferable that the discharge/heater roller 50 is disposed as close to the print head 6 as possible for preventing the sprayed ink from causing distortion of the paper P.

In addition, since the discharge/heater roller 50 discharges the paper P, it is preferable that one or more star wheels 15 are disposed above the discharge/heater roller 50 to increase a force needed for discharging paper P and at the same time to prevent sprayed ink from spreading on the paper P.

As shown, the star wheel 15 is a member having a plurality of protrusions on the outer circumference of the rotation wheel for reducing a contact surface.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An inkjet printer comprising:

a print head forming an image by spraying ink from a nozzle towards a paper;

a transfer unit for transferring the paper towards the print head;

a discharge/heater roller being in contact with a side of the paper opposite to a side with an image formed thereon by the print head for drying ink, and for discharging the paper; and one or more supporting rolls located above the discharge/heater roller for discharging paper together with the discharge/heater roller, wherein the discharge/heater roller comprises:

a heat-conductive cylindrical portion;

a roller rubber covering the cylindrical portion and generating a friction force during the discharging paper operation; and a heat-generator disposed on an inner surface of the cylindrical portion in an axial direction.

2. The inkjet printer of claim 1, wherein the discharge/heater roller is disposed close to the print head.

3. The inkjet printer of claim 1, wherein the supporting roll comprises a star wheel for minimizing a spread of ink of the image on the paper.

4. The inkjet printer of claim 1, wherein the cylindrical portion is formed of aluminum which has heat-conductivity.

5. The inkjet printer of claim 1, wherein the roller rubber is formed of a material which is heat-resistant with respect to a predetermined temperature transmitted from the heat-generator.

6. The inkjet printer of claim 1, wherein the heat-generator includes a heater coil formed of nichrome wire.

* * * * *